US010665917B2

(12) United States Patent
Frank et al.

(10) Patent No.: US 10,665,917 B2
(45) Date of Patent: May 26, 2020

(54) RADIO FREQUENCY SWITCHABLE WAVEGUIDE

(71) Applicant: Telefonaktiebolaget LM Ericsson (publ), Stockholm (SE)

(72) Inventors: Peter Frank, Carp (CA); Joel Hadden, Ottawa (CA); Roland Smith, Nepean (CA); Jim Wight, Ottawa (CA)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 128 days.

(21) Appl. No.: 15/757,999

(22) PCT Filed: Jan. 14, 2016

(86) PCT No.: PCT/IB2016/050180
§ 371 (c)(1),
(2) Date: Mar. 7, 2018

(87) PCT Pub. No.: WO2017/051259
PCT Pub. Date: Mar. 30, 2017

(65) Prior Publication Data

US 2018/0248241 A1 Aug. 30, 2018

Related U.S. Application Data

(60) Provisional application No. 62/232,577, filed on Sep. 25, 2015.

(51) Int. Cl.
*H01P 1/12* (2006.01)
*H01P 1/207* (2006.01)
(Continued)

(52) U.S. Cl.
CPC ..... *H01P 1/207* (2013.01); *H01P 5/16* (2013.01); *H01P 7/065* (2013.01); *H01Q 3/44* (2013.01);
(Continued)

(58) Field of Classification Search
CPC .... H01P 1/10; H01P 1/122; H01P 1/15; H01P 3/121
(Continued)

(56) References Cited

U.S. PATENT DOCUMENTS 3,164,792 A 1/1965 Georgiev et al.
4,595,890 A * 6/1986 Cloutier ..... H01P 1/161 333/103
(Continued)

FOREIGN PATENT DOCUMENTS

EP 0 171 149 A1 2/1986
EP 2 722 926 A2 4/2014
(Continued)

OTHER PUBLICATIONS

Djerafi-Tarek et al., Substrate Integrated Waveguide Antenna, Sep. 16, 2016, Springer, 87 pages.*
(Continued)

*Primary Examiner* — Dean O Takaoka
(74) *Attorney, Agent, or Firm* — Sage Patent Group

(57) ABSTRACT

A method and system for providing a switchable waveguide are provided. According to some aspects, a switched waveguide has a waveguide structure having a reflector located within the waveguide structure. The switched waveguide also includes a radio frequency (RF) switch configured to connect and disconnect the reflector to the waveguide structure.

27 Claims, 9 Drawing Sheets

(51) Int. Cl.

| | |
|---|---|
| ***H01P 5/16*** | (2006.01) |
| ***H01P 7/06*** | (2006.01) |
| ***H01Q 3/44*** | (2006.01) |
| ***H01Q 15/00*** | (2006.01) |
| ***H01Q 19/28*** | (2006.01) |
| *H01P 1/15* | (2006.01) |
| *H01P 3/12* | (2006.01) |
| *H01Q 13/02* | (2006.01) |

(52) U.S. Cl.
CPC ..... *H01Q 15/002* (2013.01); *H01Q 19/28* (2013.01); *H01P 3/121* (2013.01); *H01Q 13/02* (2013.01)

(58) Field of Classification Search
USPC ..... 333/101, 103, 108
See application file for complete search history.

(56) References Cited

U.S. PATENT DOCUMENTS

| | | | | |
|---|---|---|---|---|
| 5,317,293 | A * | 5/1994 | Bacon | H01P 1/15 333/258 |
| 7,705,797 | B2 | 4/2010 | Phlippakis | |
| 2010/0321132 | A1 | 12/2010 | Park | |
| 2011/0080325 | A1 | 4/2011 | Livneh et al. | |
| 2012/0169435 | A1 | 7/2012 | Kaneda et al. | |
| 2017/0012335 | A1* | 1/2017 | Boutayeb | H01P 3/121 |

FOREIGN PATENT DOCUMENTS

| | | | |
|---|---|---|---|
| EP | 2 849 276 | A1 | 3/2015 |
| JP | 2007 181893 | A | 7/2007 |
| WO | 2015/068252 | A1 | 5/2015 |

OTHER PUBLICATIONS

Lim-Inseop et al., Substrate Integrated Waveguide (SIW) Single Pole Double Throw (SPDT) Switch for X Band Applications, Aug. 2014, IEEE, vol. 24 No. 8, 3 pages.*

Ranjkesh-N et al., Loss Mechanisms in SIW and MSIW, 2008, Progress in Electronics, vol. 4, 11 pages.*

Djerafi et al.,, Substrate Integrated Waveguide Antennas, Researchgate, Jan. 2015, 60 pages.*

International Search Report & Written Opinion of the International Searching Authority dated Nov. 9, 2016 issued in corresponding PCT Application Serial No. PCT/IB2016/050180, consisting of 17-pages.

Amane Miura et al., "60-GHz-Band Switched-Beam Eight-Sector Antenna With SP8T Switch for 180° Azimuth Scan"; IEICE Transactions on Communications, Communications Society, Tokyo, Japan; vol. E93B, No. 3, Mar. 1, 2010, pp. 551-559, XP001555308, consisting of 9-pages.

PCT Invitation to Pay Additional Fees, dated Jun. 29, 2016 for corresponding International Application No. PCT/IB2016/050180, consisting of 8-pages.

* cited by examiner

RADIO FREQUENCY SWITCHABLE WAVEGUIDE

CROSS-REFERENCE TO RELATED APPLICATIONS

This application is a Submission Under 35 U.S.C. § 371 for U.S. National Stage Patent Application of International Application Number: PCT/IB2016/050180, filed Jan. 14, 2016 entitled "RADIO FREQUENCY SWITCHABLE WAVEGUIDE" and U.S. Provisional Application Ser. No. 62/232,577, filed Sep. 25, 2015 entitled "RF SWITCHABLE WAVEGUIDE," the entireties of both of which are incorporated herein by reference.

TECHNICAL FIELD

Wireless communication and in particular, switchable waveguide devices for wireless communications.

BACKGROUND

Radio Frequency (RF) Wireless Local Area Network (WLAN) technology is evolving into the EHF or "extremely high frequency" band from 30 to 300 GHz. This band, also called the millimeter band, covers radio waves with wavelengths from one to ten millimeters. This band extends from 30-300 GHz, and some applications focus on the 60 GHz ISM (industrial, scientific and medical) radio band.

Specialized RF design techniques are used when designing circuits for the millimeter band. Excessive PCB (printed circuit board) losses constrain RF signal routing to very short distances, limiting the size of antenna arrays. RF cables are also typically not used, due to losses. Power amplifier (PA) technology at 60 GHz is currently limited to 20 dBm, 16 dB lower than commercial 6 GHz WLAN PAs. Finally, first meter losses at 60 GHz are 20 dB greater than seen at 6 GHz.

Some RF solutions at 60 GHz are designed for fixed point-to-point applications, where high gain horn or horn-fed parabolic antennas are employed. In these cases, the small wavelength enables high gain antennas of 40-50 dB to be realized to support links of several km. However, these solutions cannot easily be used for point-to-multipoint Wireless LAN applications as a single radio transceiver must provide wide-angle coverage.

Other WLAN solutions targeted for the 60 GHz band employ active antenna chips with multiple transceivers. These solutions are intended for beamforming, with up to 32 active RF elements each transmitting 3-5 dBm. The combined solution achieves an appreciable gain (+36 dBm equivalent isotropically radiated power (EIRP)) if all elements are used, but is unable to achieve 360 degree coverage with this solution which assumes array antennas, and beamforming gain, since the combined antenna arrays are less than 4 cm2.

In millimeter wave applications, highly directional narrow band antennas are used due to high loss at high frequencies. Thus, when hemispherical coverage is needed, as is the case for a wireless personal area network (PAN), for example, multiple antennas are typically needed. Consequently, multiple antenna feed connections are needed. However, difficulties in printed circuit board (PCB) routing, switching and power amplification lead to designs that include high antenna array gain and active element count.

Array gain can be improved simply by increasing the gain of the individual antenna elements of the array. However, the high antenna gains tend to further restrict the directional beamforming of the combined transceiver system that includes the antenna array. For example, a 20 dBi (decibel isotropic) flat panel antenna has a typical beam width of 10 degrees in elevation and azimuth. An 8 dBi patch antenna has a typical beam width of 65 degrees in elevation and azimuth. The base element used in each element of the array determines the overall gain of the array, while limiting the beamforming capabilities. Using the following formula, $$\text{Effective beamforming gain} = \text{Fixed element gain} + 20*\log(\text{number of elements}),$$

the beam forming gain can be computed. For example, starting with an 8 dBi base element with a coverage angle of 65°×65°, the effective beamforming gain with 32 active elements is 8 dBi20*log(32)=38 dBi. Allowing 2 dB for implementation and track losses, this system would achieve 36 dBi gain along a bore sight of the antenna array, and up to 30 dBi gain at the coverage edges. This solution would not achieve significant gain past the defined coverage angle, and hence, is not a good solution for indoor omni-directional coverage.

WLAN RF designers and chip manufacturers consider solutions which follow a conventional WLAN Wi-Fi design approach using surface mount, highly integrated media access control (MAC), baseband, and RF chipset solutions to enable low radio cost products to be realized. These designs utilize printed circuit board (PCB) panel antennas—effectively fixed direction antennas, and are limited by the RF coverage of these antennas.

Referring to FIG. 1, typical microwave WLAN RF switches for Wi-Fi and other radio protocols are designed for microstrips where the signal "A" 12 is routed as a top layer of a PCB 10 where the ground layer "D" 14 is routed at a defined dielectric "C" 16 distance below the microstrip. As a result, surface mount RF switches are typically employed for lower-frequency applications, but are unsuitable for millimeter wave applications due to high losses. For at least these reasons, switchable microstrips are unsuitable for switchable routing of millimeter wave signals to omni-directional antenna configurations.

SUMMARY

Some embodiments advantageously provide a method and system for providing a switchable waveguide. According to some aspects, a switched waveguide has a waveguide structure and reflector located within the waveguide structure. The switched waveguide also includes an RF switch configured to connect the reflector to the waveguide structure and to disconnect the reflector from the waveguide structure.

According to this aspect, in some embodiments, the waveguide structure further includes a feed port configured to enable excitation of the waveguide structure. In some embodiments, when the RF switch connects the reflector to the waveguide structure, the reflector substantially reflects energy in the waveguide structure, and when the RF switch disconnects the reflector from the waveguide structure the reflector does not substantially reflect energy in the waveguide structure. In some embodiments, the switched waveguide includes at least one additional reflector and an additional RF switch per additional reflector configured to connect the additional reflector to the waveguide structure and to disconnect the additional reflector from the waveguide stricture. In some embodiments, the waveguide structure has an output port configured for connection to an antenna. In some embodiments, the waveguide structure further includes a plurality of waveguide sections, each waveguide section having a corresponding output port, each output port coupled by the corresponding waveguide section to the feed port, each waveguide section providing a separate path for a flow of energy in the waveguide structure. In some embodiments, each waveguide section includes at least one reflector and at least one RF switch configured to connect and disconnect a respective reflector to a waveguide structure of a corresponding waveguide section. In some embodiments, each of the plurality of output ports is configured for connection to a corresponding antenna. In some embodiments, the switches in the waveguide sections are programmably controllable to substantially reflect energy in one path while not substantially reflecting energy in another path. In some embodiments, the switched waveguide further includes a plurality of reflectors located within the waveguide structure, each reflector of the plurality of reflectors being connected to a corresponding RF switch that is configured to connect and disconnect the corresponding reflector to the waveguide structure. In some embodiments, the reflector has length between λg/3 and λg/8, where λg is a waveguide wavelength, defined as a function of a waveguide width 'a', speed of light 'c', relative permittivity "εr' of a material in the waveguide structure, and frequency of operation 'f' as shown below:

$$\lambda_g = \frac{2\pi}{\sqrt{\frac{\epsilon_r(2\pi f)^2}{c^2} - \left(\frac{\pi}{a}\right)^2}}$$

In some embodiments, the reflector is a monopole having a first end region and a second end region. In some embodiments, the waveguide structure has two opposite sides and the monopole extends from the gone side of the opposite sides to the other opposite side of the opposite sides the waveguide structure. In some embodiments, the RF switch element is connected to the monopole at the first end region of the monopole and a second RF switch element is connected to the monopole at the second end region of the monopole, the first end region being opposite the second end region. In some embodiments, the waveguide structure is a substrate integrated dielectric waveguide structure.

According to another aspect, a switched waveguide includes a waveguide structure including a feed port that enables excitation of the waveguide structure. The switched waveguide includes a first reflector located within the waveguide structure, the first reflector having a first end region and a second end region. Also included is a first RF switch configured to connect the first end region of the reflector to the waveguide structure and to disconnect the first end region of the reflector to the waveguide structure. A second RF switch is configured to connect the second end region of the reflector to the waveguide structure and to disconnect the second end region of the reflector from the waveguide structure.

According to this aspect, in some embodiments, the switched waveguide further includes at least one additional reflector located within the waveguide structure between the feed port and the first reflector. In some embodiments, at least a third RF switch is configured to connect the at least one additional reflector to the waveguide structure and to disconnect the at least one additional reflector from the waveguide structure. In some embodiments, the reflector has a diameter less than λg/2, where λg is the waveguide wavelength. In some embodiments, the reflector has a diameter greater than λg/8, where λg is the waveguide wavelength. In some embodiments, the first RF switch is one of a PIN diode, a MEMS RF switch and a solid state switch. In some embodiments, the waveguide structure is one of an air and vacuum waveguide structure. In some embodiments, the waveguide structure includes a plurality of waveguide sections, each waveguide section having an output port, each output port coupled by the waveguide section to the feed port, each waveguide section providing a separate path for a flow of energy in the waveguide structure.

According to yet another aspect, a switched waveguide includes a waveguide structure having a feed port configured to enable excitation of the waveguide structure. The switched waveguide includes a first reflector located within the waveguide structure. The first reflector includes a first end region connected to the waveguide structure and a second end region connected to a first radio frequency (RF) switch. The first RF switch is configured to connect the first end region of the first reflector to the waveguide structure and to disconnect the first end region of the first reflector to the waveguide structure.

According to this aspect, in some embodiments, the waveguide structure includes a plurality of waveguide sections, each waveguide section having a corresponding output port, each output port coupled by the corresponding waveguide section to the feed port, each waveguide section providing a separate path for a flow of energy in the waveguide structure. In some embodiments, each of a plurality of the output ports are configured to connect to an antenna. In some embodiments, the waveguide structure has an output port configured to connect to a horn antenna.

According to another aspect, a radio frequency (RF) device includes a waveguide structure having a feed port and an output. The RF device also includes an antenna electrically connected to the output. A reflector is located within the waveguide structure between the feed port and the output and an RF switch is configured to connect the reflector to the waveguide structure and to disconnect the reflector from the waveguide structure.

According to this aspect, in some embodiments, when the RF switch connects the reflector to the waveguide structure, the reflector substantially reflects energy in the waveguide structure, and when the RF switch disconnects the reflector from the waveguide structure, the reflector does not substantially reflect energy in the waveguide structure.

According to yet another aspect, an RF device includes a waveguide structure, the waveguide structure including, a feed port and a plurality of waveguide sections. Each waveguide section has an output port, each output port coupled by the waveguide section to the feed port, each waveguide section providing a separate path for a flow of energy in the waveguide structure. The RF device also includes a reflector located within each waveguide section of the waveguide structure and an RF switch within each waveguide section. An RF switch is configured to connect a corresponding reflector in the waveguide section to the waveguide structure and to disconnect the reflector from the waveguide structure. The RF device also includes a plurality of antennas, an antenna of the plurality of antennas being electrically connected to each output port.

According to this aspect, in some embodiments, the switches in the waveguide sections are programmably controllable to substantially reflect energy in one path while not substantially reflecting energy in another path.

BRIEF DESCRIPTION OF THE DRAWINGS

A more complete understanding of the present embodiments, and the attendant advantages and features thereof, will be more readily understood by reference to the following detailed description when considered in conjunction with the accompanying drawings wherein.

DETAILED DESCRIPTION

Figure 1:
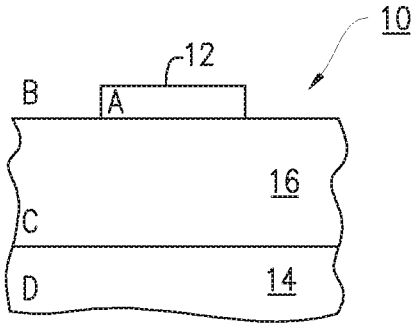
(Prior Art) FIG. 1
FIG. 1 is a diagram of a microstrip transmission line.

Before describing in detail exemplary embodiments, it is noted that the embodiments reside primarily in combinations of apparatus components and processing steps related to switchable waveguide devices for wireless communications. Accordingly, components have been represented where appropriate by conventional symbols in the drawings, showing only those specific details that are pertinent to understanding the embodiments so as not to obscure the disclosure with details that will be readily apparent to those of ordinary skill in the art having the benefit of the description herein.

As used herein, relational terms, such as "first" and "second," "top" and "bottom," and the like, may be used solely to distinguish one entity or element from another entity or element without necessarily requiring or implying any physical or logical relationship or order between such entities or elements.

Some embodiments of the present disclosure take advantage of millimeter wave band features such as the ability to embed integrated waveguides into the substrate of the PCB, and the ability to route signals within the waveguides to horn antennas which provide high gain and directionality.

According to some embodiments, a switching solution which uses surface mount PIN diodes or micro-electro-mechanical system (MEMS) elements (or other switches) to affect the impedance of monopoles located inside a waveguide to cause the waveguide to reflect or pass an RF signal is provided. This solution may be used to enable traditional or future waveguide and horn antenna technologies to be used to achieve improved directional gains.

According to some embodiments, low loss waveguides enable RF signals to be routed and switched to various horns or horn feeders, and the switching capability enables a low complexity transceiver design to be realized.

According to some embodiments, the waveguide switching technique employs one or more reflectors integrated into each one of one or more waveguides. These integrated reflectors may assume one of two states—open (ungrounded) or closed (grounded). The state action is achieved through the use of a switch, such as a PIN diode, MEMs switch, a solid state device switch. In one embodiment, the one or more reflectors are included inside the waveguide, but the RF switch is located outside the waveguide (e.g. surface mounted).

In one embodiment, a single reflector is used. More reflectors may advantageously be used to achieve wider bandwidths. For example, two or more reflectors may be used to cover a full 60 GHz band, representing a 20% bandwidth. The distance between reflectors, the height of reflectors, and the radius (or diameter) of reflectors can be chosen to improve various properties.

According to some embodiments, N-Way switches (e.g. 2-way, 3-way, and 4-way switches) are provided. According to some embodiments, a low loss solution enabling 360° coverage by cascading switches is provided. For example, using five four-way switches, with four switches subtending a fifth four-way switch, a single RF signal may be switched into one of 16 different waveguides.

Figure 2:
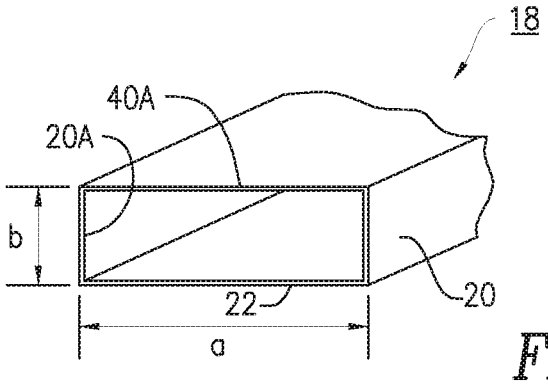
FIG. 2 is a diagram of a rectangular waveguide.
Figure 3:
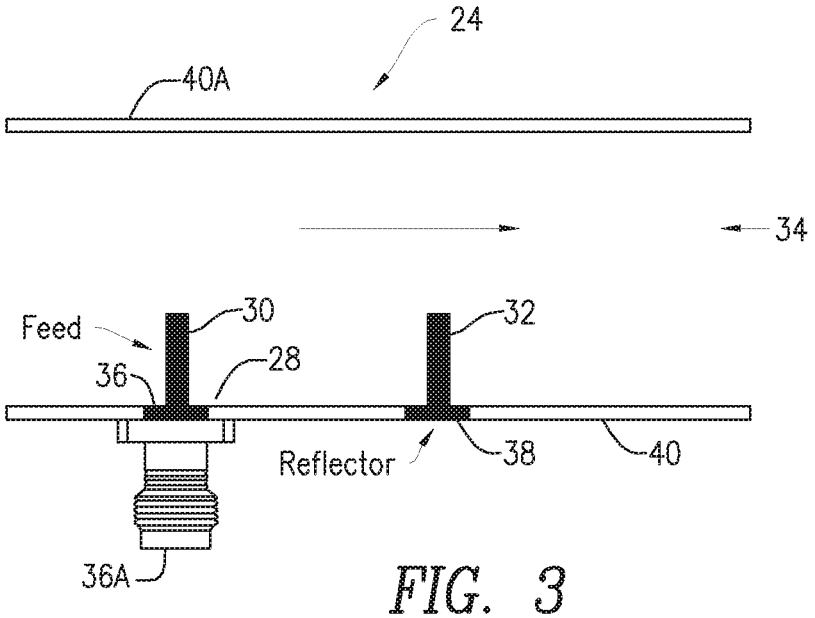
FIG. 3 is cross section of a waveguide section with a feed and a monopole reflector.

Referring to FIG. 2, according to some embodiments, a rectangular dielectric waveguide 18 of depth 'b' 20 and width 'a' 22 is enabled to carry RF signals. The dielectric-filled waveguide of FIG. 2 may be embedded in a PCB. Of note, although FIG. 2 shows a "rectangular" waveguide structure, it is understood that this arrangement is only an example embodiment. Implementations are not limited to "rectangular" structural arrangements. In FIG. 2, a lower broad wall of the waveguide 18 is designated as 40 and an upper broad wall of the waveguide 18 is designated as 40A. A typical dielectric to fill the waveguide is Polytetrafluoroethylene (PTFE), and for example, could be RT/Duroid 5880 glass microfiber reinforced PTFE composite, but embodiments herein are not limited to this material. FIG. 3 is a cross section of a waveguide section 24 of a waveguide 18, including a feed port 28, a feed element 30, a monopole reflector 32 and an output port 34 for coupling the waveguide section 24 to a waveguide section or antenna (not shown). The direction of signal propagation is shown by the arrow within the waveguide section. The feed element 30 may be a via driven by a coaxial connector or a power amplifier on a PCB, and the monopole reflector 32 may be a via that is sized to affect the bandwidth of the waveguide section 24. The waveguide 18 may be formed on a dielectric substrate with metal surfaces such as a substrate filled waveguide or substrate integrated waveguide.

Feed element 30 and monopole reflector 32 may be partially or fully surrounded at their bases by an air cut out 36 and 38, respectively, that is cut out of the ground plane of the lower broad wall 40 of the waveguide section 24. In the case of the feed element 30, the cut out 36 allows energy to flow in and out of the waveguide. Fixed within the cutout 26 is, in some embodiments, a connector 36A. In the case of the monopole reflector 32, the cut out 38 allows for an RF switch (such as transistor, diode, a MEMS, a solid stated device switch, etc.) to be placed between the monopole reflector 32 and the lower broad wall 40 of the waveguide section 24. This arrangement gives the ability to control whether the monopole reflector 32 is floating (electrically open) or grounded (electrically shorted) to the lower broad wall 40 based on the signal applied to the switch. In this embodiment, the waveguide structure, e.g., the lower broad wall 40 and/or the upper broad wall 40A, act as a virtual ground. In other embodiments, a specific ground element can be used.

In some embodiments, when the RF switch is off, there is no connection between the ground plane and the monopole reflector. The result is a non-resonant quarter wavelength conductor which allows energy to pass by. However, when the RF switch is turned on, there is a connection made between the lower broad wall 40 and the monopole reflector 32. The monopole reflector 32 appears as a resonant half wavelength reflector and substantially reflects incoming energy. Thus, from the perspective of the output port 34, the feed port 28 is seen when the RF switch is off, and the feed port 28 is blocked when the RF switch is on. Note that although a monopole reflector is shown in the various embodiments, which may be implemented with a wire conductor, other reflecting structures, such as metal strips may also be employed.

Thus, according to some embodiments, a reflector (such as a monopole), located inside the waveguide is coupled to a surface mount RF switch, located outside the waveguide. A low capacitance, surface mount RF switch can be employed, while a millimeter wave signal (or other electromagnetic signal) is carried in the waveguide structure. The external RF switch can control the transmission of the signal inside the waveguide.

Figure 4:
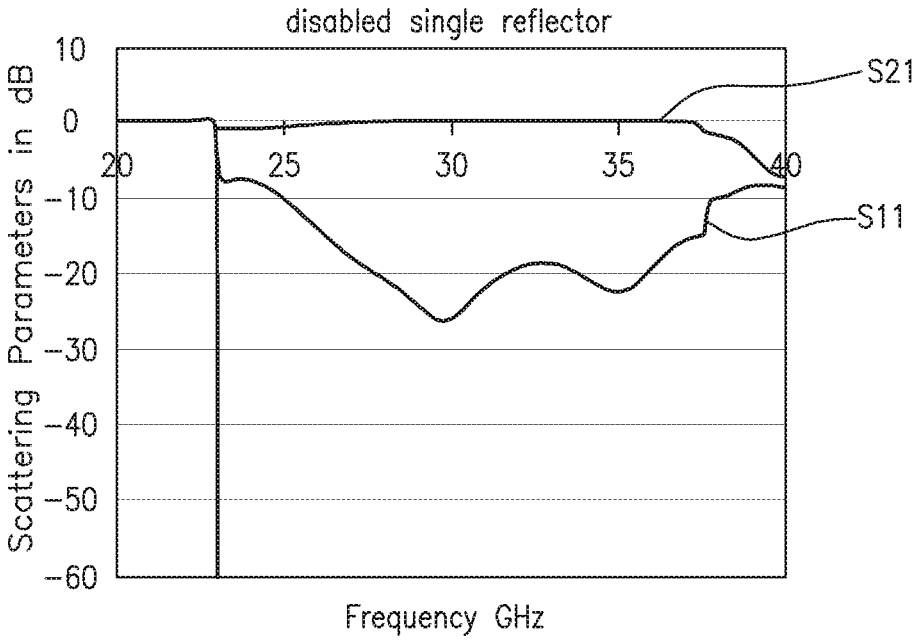
FIG. 4 is a graph of S-parameters versus frequency achievable with a single monopole reflector in a disabled state.

FIG. 4 is a graph of scattering parameters (S-parameters) S11 and S21 obtained by simulation of a single monopole reflector 32 that is disabled by an RF switch in the off state. The scattering parameter S11 is a measure of how much energy is reflected by the monopole reflector 32 and the scattering parameter S21 is a measure of how much energy is transmitted past the monopole reflector 32.

As noted above, when the RF switch is in the off state, the reflection parameter S11 is less than −10 dB over a 12 GHz band width from 25 to 37 GHz, and the transmission parameter S21 is at or near zero dB over the bandwidth. Thus, most of the energy is transmitted past the monopole reflector when the RF switch is in the off state, thus allowing switchably feeding an antenna connected to the waveguide.

Figure 5:
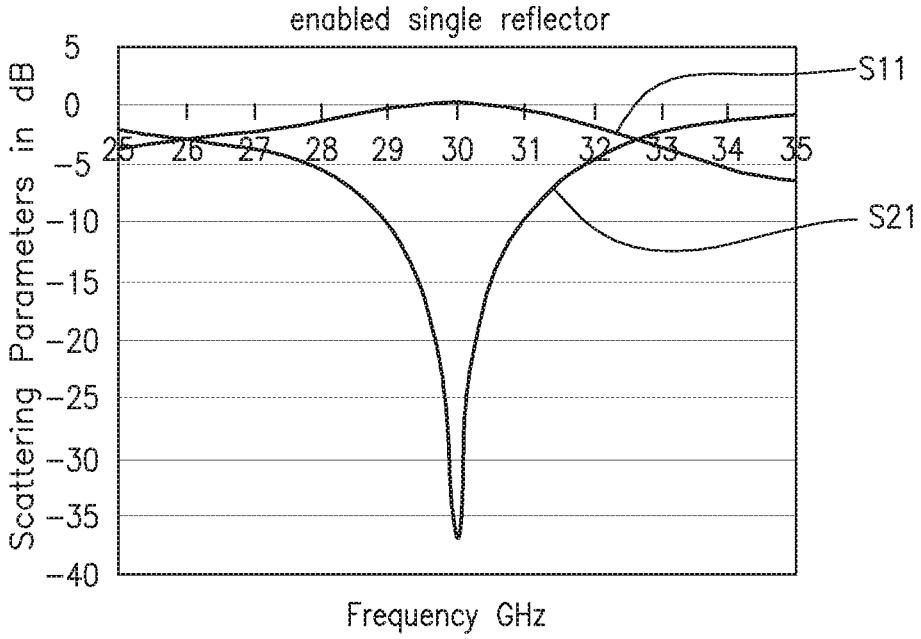
FIG. 5 is a graph of S-parameters versus frequency achievable with a signal monopole reflector in an enabled state.

FIG. 5 is a graph of the S-parameters S11 and S21 when the monopole reflector is enabled by the RF switch in the on state. When the RF switch is in the on state, the monopole reflector 32 is connected to ground and appears as a resonant half wave reflector and reflects energy. This is shown by the reflection parameter S11 being near zero dB and the transmission parameter S21 dipping below −10 dB over a broad band. Thus, most of the energy is reflected when the RF switch is in the on state. This enables turning off the path of energy flow to an antenna connected to the waveguide section 24.

Figure 6:
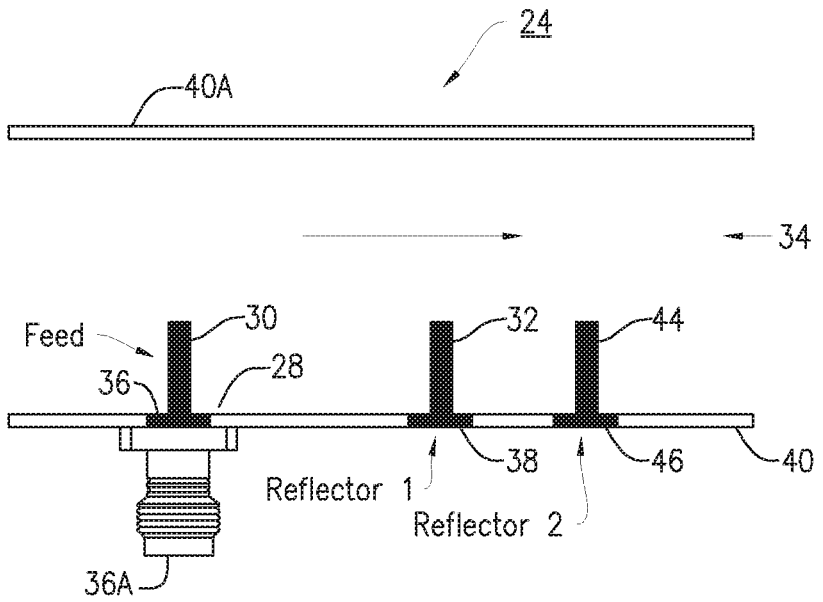
FIG. 6 is a cross section waveguide section with a feed and two monopole reflectors.

FIG. 6 is a side view of a waveguide section 42 having two in-line monopole reflectors 32 and 44 with cut outs 38 and 46, respectively. The direction of signal propagation is shown by the arrow within the waveguide section. Both monopole reflectors 32 and 44 are connectable to the lower broad wall 40 by a separate RF switch at the base or end region of each monopole reflector. Adding a second monopole reflector improves the bandwidth of S21 when both switches are in the "on" state. Note that improved bandwidth increases the bandwidth over which an output port connected to the waveguide section 42 is isolated from the feed 30, and thereby increases the effective bandwidth of operation of a transceiver feeding the waveguide section 42.

Figure 7:
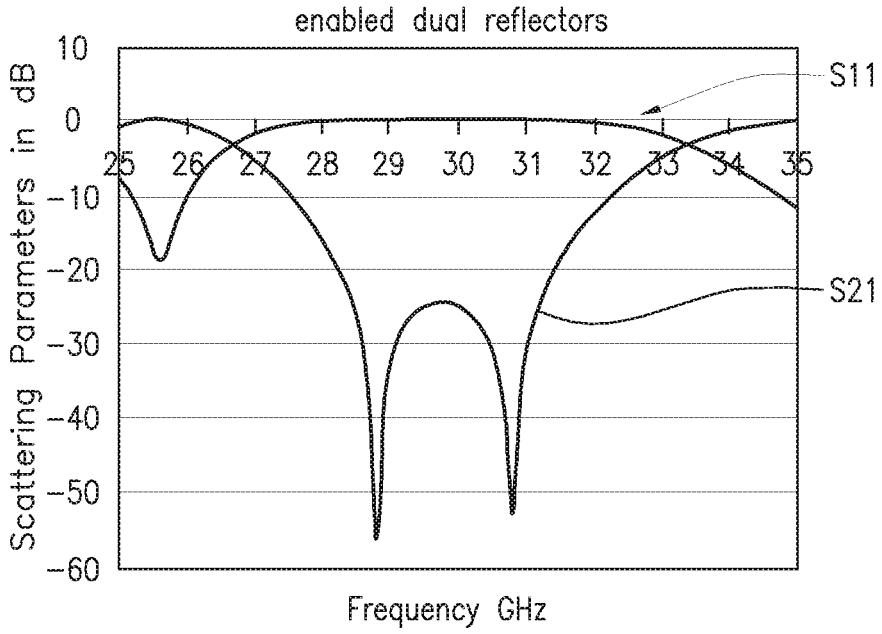
FIG. 7 is a graph of S-parameters versus frequency achievable with two monopole reflectors in an enabled state.

FIG. 7 is a graph of S-parameters S11 and S21 when the RF switch at each monopole reflector 32, 44 is in the on state, connecting the monopole reflectors 32, 44 to lower broad wall 40. By adding a second monopole reflector 44, the bandwidth of the transmission parameter S21 below −20 dB increases substantially. In particular, the fractional −10 dB bandwidth increases from 6.7% to 16.67% of a center frequency of the band. Note that the graph of FIG. 7 shows two deep resonances. Each resonance corresponds to a different one of the two monopole reflectors 32, 44. Note also that the depth of the S21 curve within an operating bandwidth improves the isolation provided by the monopole reflectors 32 and 44.

Figure 8:
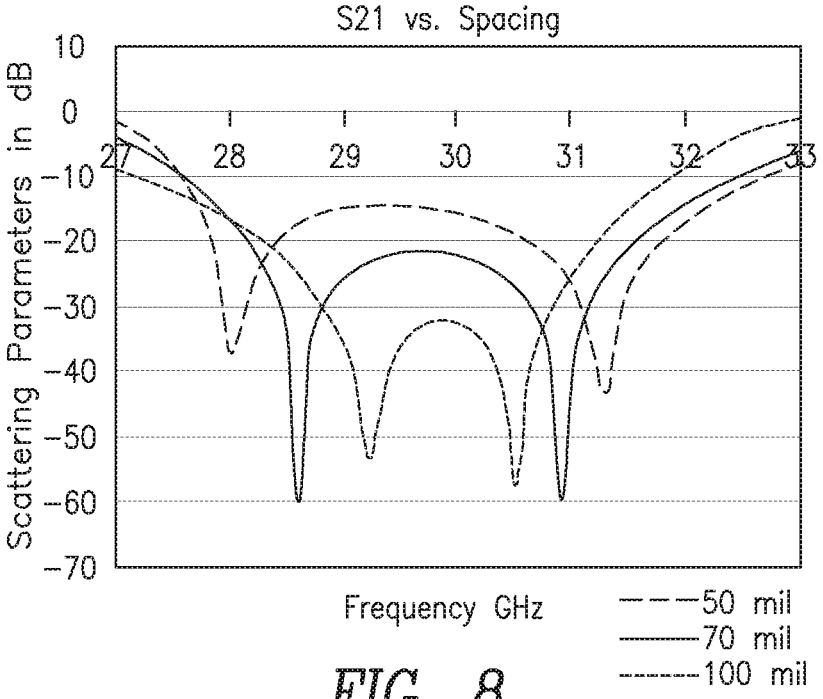
FIG. 8 is a graph of S21 versus frequency for different spacings between two enabled monopole reflectors.

FIG. 8 is a graph of S21 for three different spacings between the two monopole reflectors 32 and 44. Generally, as the spacing between the two monopole reflectors increases, S21 −30 dB bandwidth increases. Thus, for example, a spacing of 100 mils provides the broadest −30 dB bandwidth. An optimal spacing may be about λg/5, where λg waveguide wavelength and is a function of the width 'a', speed of light 'c', relative permittivity of the material 'εr', and frequency of operation 'f' as shown below:

$$\lambda_g = \frac{2\pi}{\sqrt{\frac{\epsilon_r (2\pi f)^2}{c^2} - \left(\frac{\pi}{a}\right)^2}}$$

Figure 9:
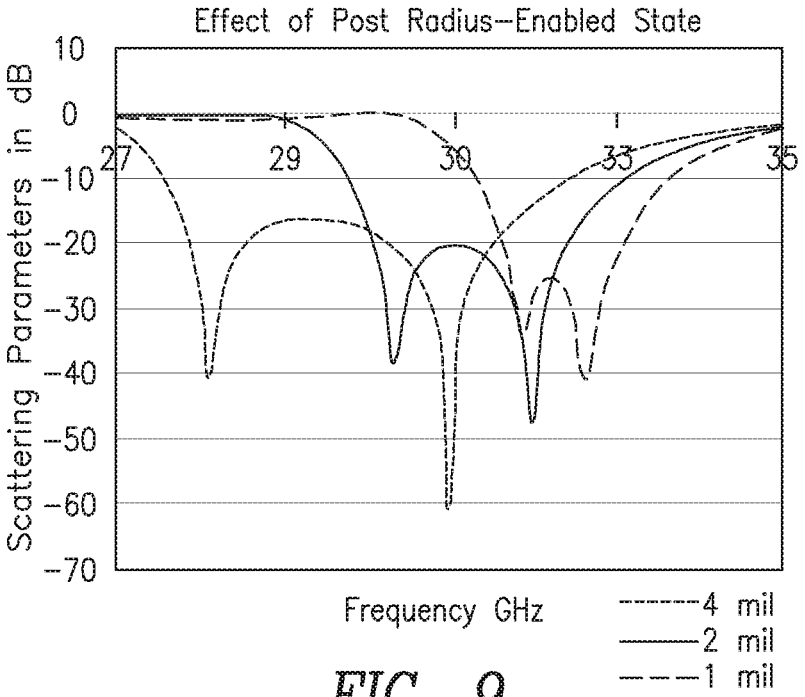
FIG. 9 is a graph of S21 versus frequency for different radii of two enabled monopole reflectors.

The size of the monopole reflectors (height and diameter) can be chosen to affect the performance of the waveguide section. For example, as the radius of the monopole reflector increases, the bandwidth of S21 tends to increase, the depth of S21 tends to decrease, and the response shifts to a lower frequency range. These trends are shown in FIG. 9. For example, the 4 mil radius provides a broader bandwidth than the 2 mil radius but the operational bandwidth is shifted to a lower frequency. In particular, the −10 dB bandwidth of the 2 mil radius is about 3 GHz centered at about 31 GHz, whereas the −10 dB of the 4 mil radius is about 10 GHz centered at about 30 GHz.

Figure 10:
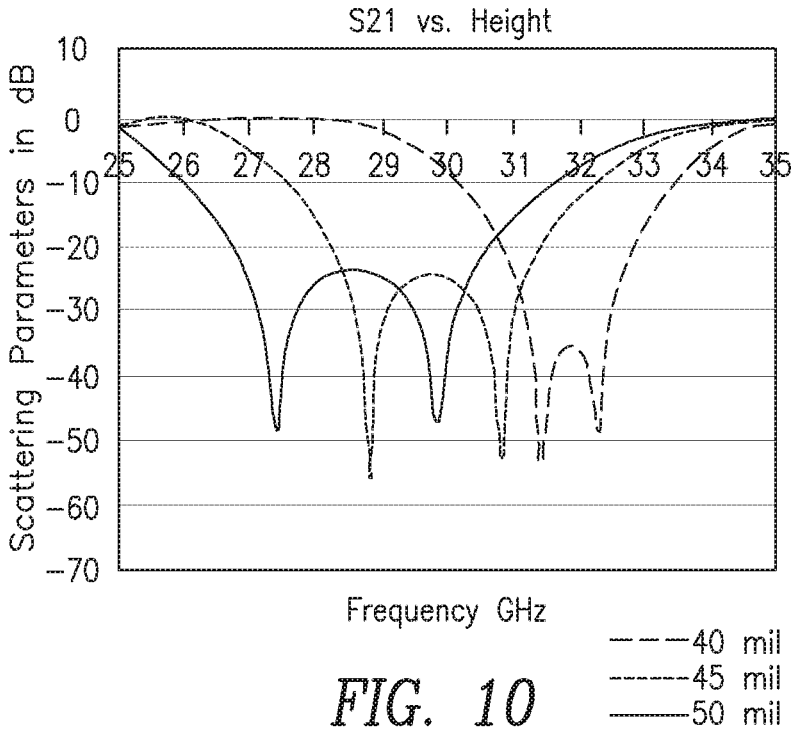
FIG. 10 is a graph of S21 versus frequency for different heights of two enabled monopole reflectors.

The effect of the height of the monopole reflectors is shown in FIG. 10, which shows that as height increases, the reflection occurs at lower frequencies. Conversely, as height decreases, the reflection occurs for higher frequencies. Also, bandwidth increases as height increases. For example, a bandwidth of 3.5 GHz at a center frequency of 31.5 GHz is observed for a post height of 40 mil. In comparison, the 60 mil post provides a bandwidth of 7 GHz at a center frequency of 26.5 GHz. Thus, a large bandwidth advantage, compared to a smaller reflector height, may be obtained using the disclosed structure if operation at a lower frequency is an option.

Instead of adjusting both heights of the two monopole reflectors equally, one height may be adjusted to be greater than the other height, causing a movement of a resonance associated with the adjusted height. Thus, a shorter reflector height results in a lower bandwidth than a taller reflector height. Note also that increasing the height of the waveguide, while keeping the height of the reflectors constant, tends to narrow the bandwidth.

Note also that a maximum power transfer when the monopole reflectors are in the disabled state occurs when the height of the waveguide is about 2.7 times the height of the monopole reflectors, while still providing a bandwidth of about 6 GHz. Greater or lesser than an optimal waveguide height may diminish performance. Note further that the size of the cutout also affects performance. Greater or lesser than an optimal cutout size may diminish performance, providing a tradeoff between depth of resonance, frequency of resonance and bandwidth.

Figure 11:
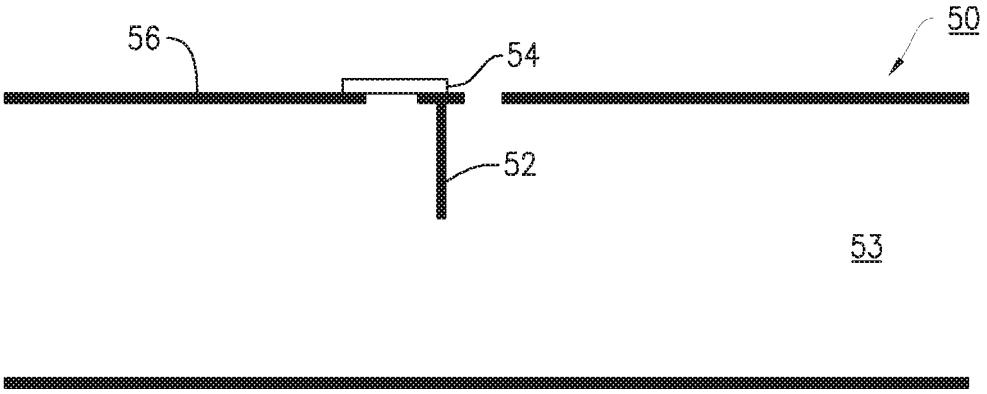
FIG. 11 is a cross section of a waveguide with a stub monopole reflector connected to a switch.

FIG. 11 is cross section of a switchable waveguide having a waveguide structure 50 that includes a stub monopole reflector 52 connectable by an RF switch 54 to the upper broad wall 56. In other words, the RF switch is configured to connect the monopole reflector 52 to the upper broad wall 56 and to disconnect the monopole reflector 52 from the upper broad wall 56. In some embodiments, the monopole reflector height ranges between λg/3 and λg/8, where λg is the waveguide wavelength, defined above. The waveguide wavelength is measured in the dielectric 53 of the dielectric filled waveguide 50. Simulations indicate that an optimal monopole reflector height may be λg/6. In one embodiment, the diameter of the monopole reflector may be less than λg/5. The single monopole reflector operates in one of two states: shorted/open. In the shorted state, (RF switch 54 in the on state) the monopole is resonant, and reflects all energy in the waveguide. In the open state (RF switch 54 in the off state), the monopole acts as an open circuit, and allows all energy in the waveguide to pass. In some embodiments, the RF switch 54 is a surface mount RF switch or a pin diode. In some embodiments, the surface mount RF switch is a low capacitance switch.

Figure 12:
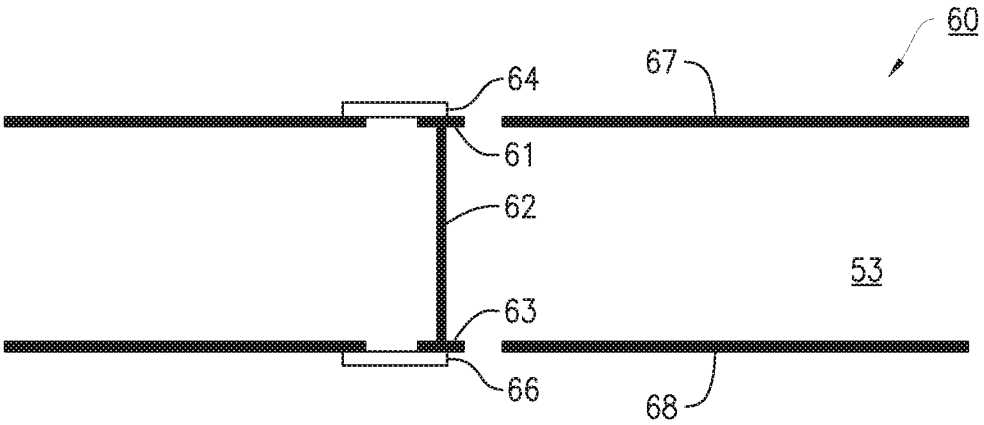
FIG. 12 is a cross section of a waveguide with a monopole reflector and two switches.

FIG. 12 is a diagram of a waveguide structure 60 having a monopole reflector 62 that extends from a lower broad wall 68 of the waveguide structure 60 to the upper broad wall 67 of the waveguide 60. At each end region 61, 63 of the monopole reflector 62 is an RF switch 64 and 66. When the switches 64 and 66 are in an off state, energy passes by the monopole reflector 62 and when the switches 64 and 66 are in the on state, energy is reflected by the monopole reflector 62.

Figure 13:
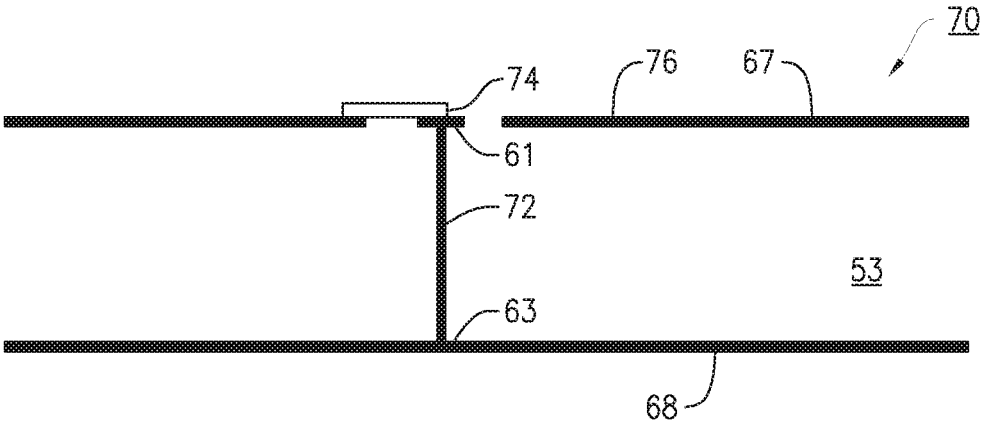
FIG. 13 is a cross section of a waveguide with a monopole reflector and one switch.

FIG. 13 is a diagram of a waveguide structure 70 having a monopole reflector 72 that extends from a lower waveguide broad wall 68 to an upper waveguide broad wall 67. One end region 61 of the monopole reflector 72 is terminated at one wall and the other end region 63 is connectable by an RF switch 74 to upper broad wall 76. When the RF switch 74 is in an off state, energy passes by the monopole reflector 72 and when the RF switch 74 is in the on state, energy is reflected by the monopole reflector 72. Whether to use the configuration of FIG. 12 or FIG. 13 may depend on the application. Some circuit applications may need a greater waveguide height for lower losses. Having a via extending from the lower broad wall 68 to the upper broad wall 67 could be used, for example, for an electrically thin PCB/waveguide configuration.

Figure 14:
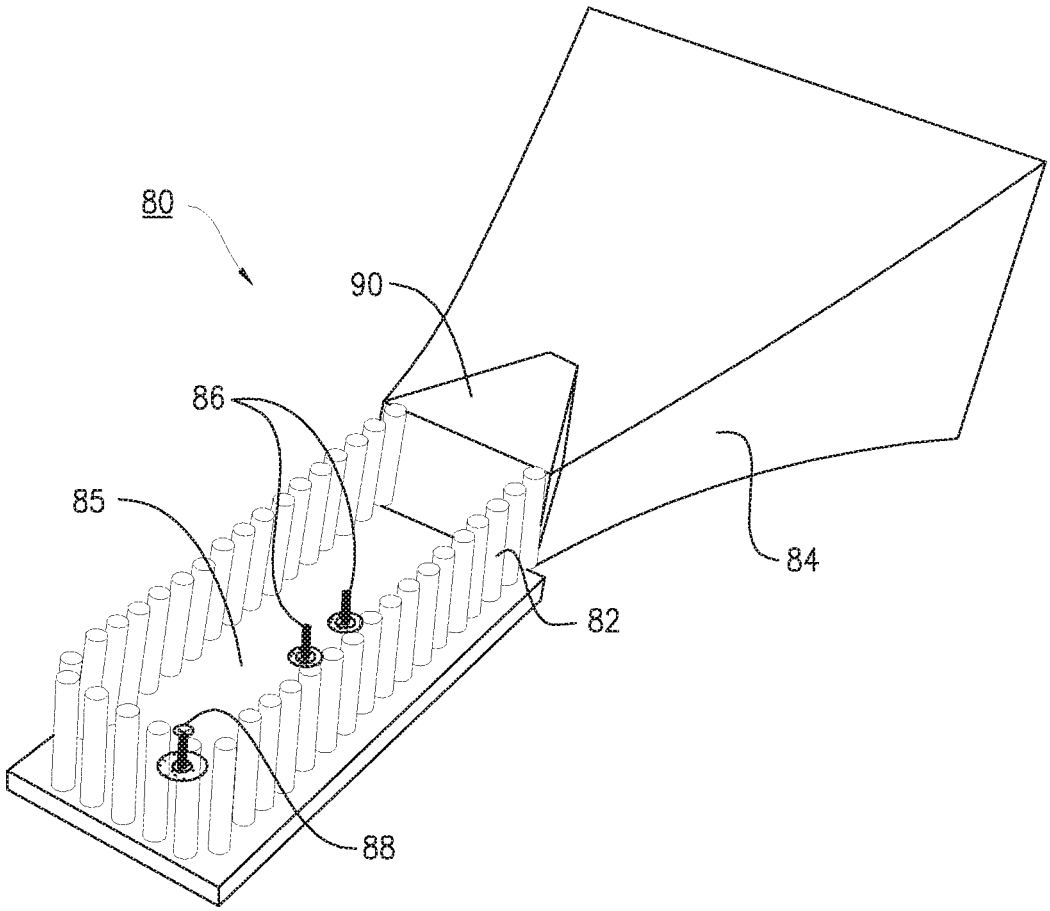
FIG. 14 is a perspective view of a switchable waveguide, structure feeding a horn antenna.

FIG. 14 is a perspective view of a waveguide, horn antenna combination 80. The waveguide 85 may be formed by many closely spaced vias 82, and upper and lower ground planes (not shown) that enclose two monopole reflectors 86 in each branch fed by a feed via 88. The two monopole reflectors 86 are controlled by switches (not shown) described above that connect or disconnect the monopole reflectors 86 to the lower ground plane. The upper and lower ground planes are metal layers in the PCB. The waveguide feeds a horn antenna 84 via a dielectric taper 90. In order to minimize energy leakage, it is desirable to reduce spacing as much as possible. That said, minimal distances are usually governed by manufacturer tolerances. For example, manufacturing restrictions may require that vias be spaced a minimum of 10 mil from the edge of a via to the edge of another via.

Formulae for determining via parameters are as follows:

$$p < 2d$$

$$d < \frac{\lambda g}{5}$$

where d is the via diameter and p is the spacing between via centers. For example, with dielectric constant of $\varepsilon_r$=2.2, f=30 GHz and waveguide height=5 mm, λg=9.1 mm or 358 mil. These results yield a maximum via diameter of d=1.82 mm.

In order to approximate the straight edge of a waveguide wall, the diameter of the vias 82 may be reduced and spaced more closely together within manufacturing limitations. A via diameter of 20 mil restricts via spacing to less than 40 mil. For a minimum edge to edge spacing of 10 mil, via separation will be 30 mil, which gives a 10 mil margin from the minimum spacing requirement. To summarize, in this example, final sizing will be a spacing 'p' from center to center of 30 mil and a via diameter of 20 mil.

Waveguides may be arranged to propagate the dominant TE10 mode of energy propagation to prevent degenerate modes from oscillating, where TE10 is indicative of the mode structure of electromagnetic energy within the waveguide. The waveguide may be configured to operate in the TE10 mode for a given frequency by selection of the waveguide dimensions. Energy contained in different modes will travel at different velocities. This results in signal dispersion or pulse spreading. This pulse spreading can result in inter-symbol interference which increases the bit error rate, effectively degrading communications. This is normally a concern in media such as optical fiber where the signal must traverse long distances. However, distances traversed in wireless communications between the transceiver and antenna will typically be short.

A second problem with propagating degenerate modes is loss. If multiple modes are propagated, separate probes in different places are required to capture the energy on the receive side. Since some embodiments described herein offer single mode operation, only one probe is present to capture energy. This avoids un-captured energy which is seen as a loss. Thus some embodiments are arranged to only propagate the dominant mode, TE10.

In one example, the cutoff frequency, fc, may be chosen to be 20 GHz. This produces an acceptable band of operation from 25 GHz to 37.8 GHz. This is plenty of spectrum for a target of 3.5 GHz bandwidth centered at 30 GHz. For fc=20 GHz, $\epsilon_r$=2.2 and $\mu_r$=1, the waveguide width is 5 min. This new width is 70% of the width calculated for an air filled waveguide. Thus, the impact of the dielectric on size may be significant.

The dielectric taper shown in FIG. 14, avoids an abrupt change in dielectric constant between the dielectric of the waveguide and the air inside the horn antenna 84. As explained above, the feed via 88 allows energy to flow into and out of the waveguide, horn antenna combination 80. The monopole reflectors 86 function to pass energy between the feed point 88 and the horn antenna 84 when switches (not shown) are in the off state, and to reflect energy from the feed point and the horn antenna when the switches are in the on state.

Figure 15:
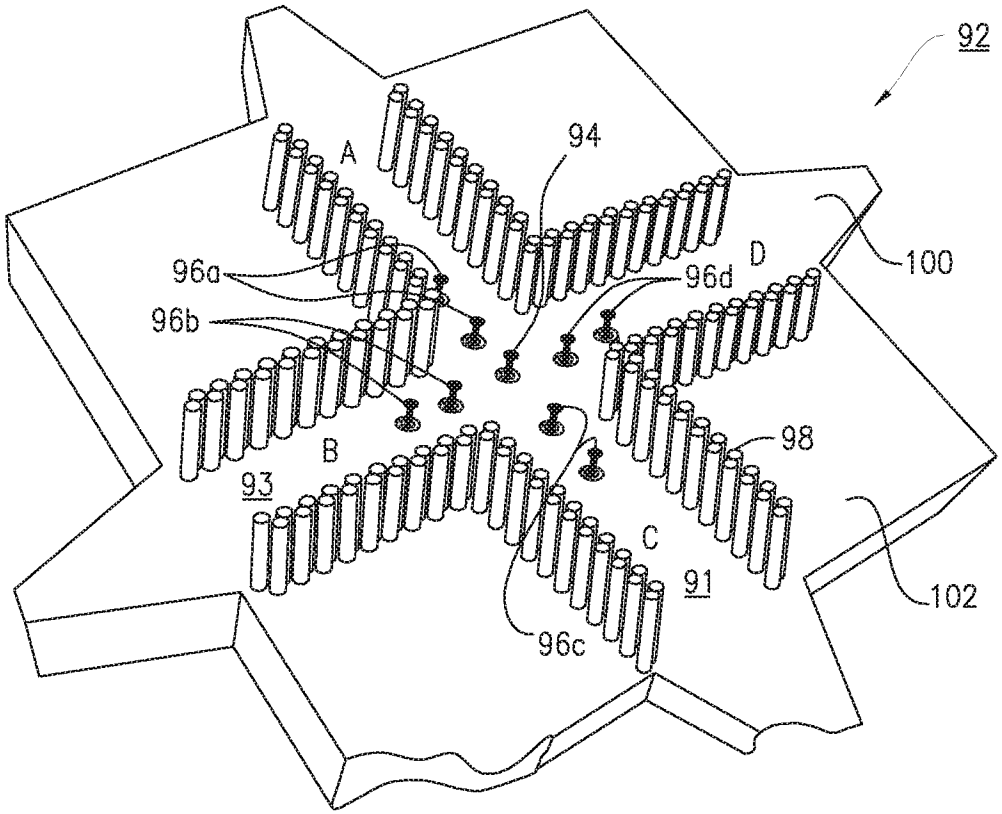
FIG. 15 is a five port device with four switchable waveguide sections.

FIG. 15 is a perspective view of a four port switchable waveguide 92 having a center feed point 94 and monopole reflectors 96. The waveguide walls may be formed by vias 98. Note that there are monopole reflectors 96 in each path so that all but one, two or three paths may be switched "on" to pass energy. The switches for each monopole reflector may be programmable by a digital signal to select one or more paths for propagation at a time. Thus, once the energy is present inside the structure 92, the energy will propagate until it encounters a pair of activated monopole reflectors 96 and will be reflected thereby. One or more pair of monopole reflectors 96 may be deactivated to pass energy there through. Each path terminates in a taper 100 that may be used to transition to a horn antenna, not shown. The configuration 92 includes a lower around plane 102 and an upper ground plane (not shown).

Thus, in the embodiment of FIG. 15, each monopole reflector pair is digitally controllable to be in an enables or disabled state by way of switching elements (such as PIN diodes, microelectromechanical switch (MEMS) or other solid state switches). For example, if three monopole reflector pairs are enabled, such as the three monopole reflector pairs 96*a*, 96*b* and 96*c* in channels A, B and C, each pair will reject the incoming energy and its only escape will be past the pair of disabled monopole reflectors, such as the monopole reflector pairs 96*d* in channel D. The result is a programmable omni-directional antenna structure where emission direction can be selected by digital signal. Using two monopole reflectors in each waveguide section achieves greater bandwidth, as explained above with reference to FIGS. 6 and 7. Not also that some embodiments may include multi-layer routing. Also, some embodiments may be used for beamforming and/or polarization diversity.

Figure 16:
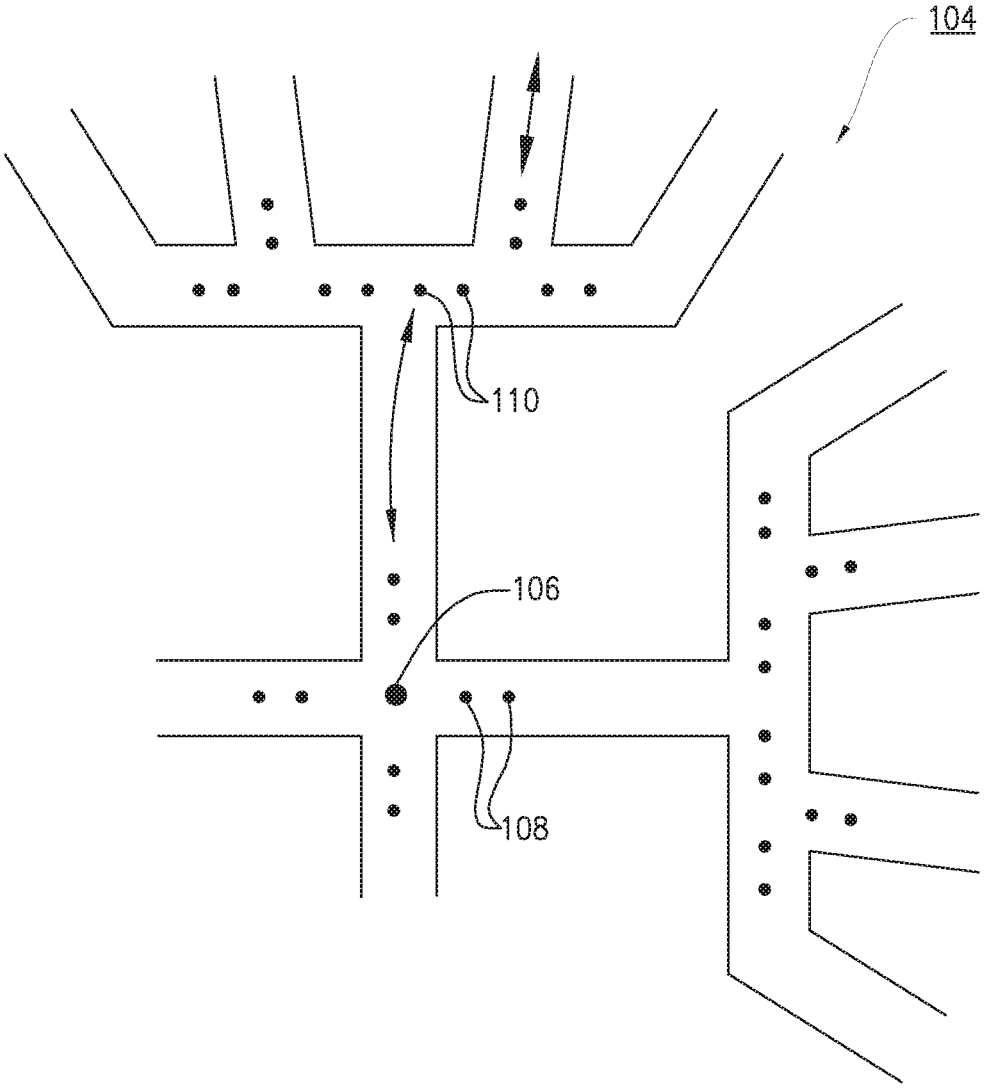
FIG. 16 is a portion of a seventeen port device feeding up to sixteen antenna elements.

Thus, the structures described herein may be adapted to create N-way switching, where N is an integer greater than one. FIG. 16 shows a portion of an N-way switchable waveguide structure 104, having a center feed 106, activated monopole reflectors 108 and deactivated monopole reflectors 110. Note that in FIG. 16, the activated monopole reflectors are shown as blackened circles whereas the deactivated monopole reflectors are shown as open circles. The arrows in FIG. 16 show the selected path for energy flow.

Some embodiments described herein provide efficient switching of millimeter wave signals within a waveguide structure while using surface mount RF switch components. Some embodiments provide a low insertion loss antenna and antenna feed design with high operational bandwidth. Some embodiments enable millimeter wave point to multi-point applications, and facilitate the use of a larger array of high gain antennas, such as horn antennas.

Some embodiments include a switching solution using surface mount switches and stubs to create switchable waveguide structures. The switching solution of some embodiments described herein enable use of traditional antennas such as horn antennas having very high fixed direction gains. The low loss switchable waveguides contemplated herein enable RF signals to be monitored to be routed and switched to various horns and enables a simpler transceiver to be realized.

The described methods and apparatuses are presented for purpose of illustration and not of limitation. It should be understood that various changes, substitutions and alterations can be made and still fall within the broad scope of the present methods and apparatuses described in this specification. For example, many of the features and functions discussed above can be implemented in software, hardware, or firmware, or a combination thereof. Also, many alternatives, variations, and modifications will be apparent to those of ordinary skill in the art. Other such alternatives, variations, and modifications are intended to fall within the scope of the following claims.

What is claimed is:

1. A switched waveguide, comprising:

a waveguide structure;

a reflector located within the waveguide structure, wherein the reflector is a monopole having a first end region and a second end region, wherein the reflector has length between λg/3 and λg/8, where λg is a waveguide wavelength, defined as a function of a waveguide width 'a', speed of light 'c', relative permittivity "εr' of a material in the waveguide structure, and frequency of operation 'f' as follows:

$$\lambda_g = \frac{2\pi}{\sqrt{\frac{\epsilon_r(2\pi f)^2}{c^2} - \left(\frac{\pi}{a}\right)^2}}$$

a radio frequency, RF switch element configured to connect and disconnect the reflector to the waveguide structure, wherein the RF switch element is connected to the monopole at the first end region of the monopole and a second RF switch element is connected to the monopole at the second end region of the monopole, the first end region being opposite the second end region.

2. The switched waveguide of claim 1, wherein the waveguide structure further includes a feed port configured to enable excitation of the waveguide structure.

3. The switched waveguide of claim 2, wherein, when the RF switch element connects the reflector to the waveguide structure the reflector substantially reflects energy in the waveguide structure, and when the RF switch element disconnects the reflector from the waveguide structure the reflector does not substantially reflect energy in the waveguide structure.

4. The switched waveguide of claim 2, wherein the waveguide structure has an output port configured for connection to an antenna.

5. The switched waveguide of claim 2, wherein the waveguide structure further includes a plurality of waveguide sections, each waveguide section having a corresponding output port, each output port coupled by the corresponding waveguide section to the feed port, each waveguide section providing a separate path for a flow of energy in the waveguide structure.

6. The switched waveguide of claim 5, wherein each waveguide section includes at least one reflector and at least one RF switch element configured to connect and disconnect a respective reflector to a waveguide structure of a corresponding waveguide section.

7. The switched waveguide of claim 6, wherein each of the plurality of output ports is configured for connection to a corresponding antenna.

8. The switched waveguide of claim 6, wherein the switches in the waveguide sections are programmably controllable to substantially reflect energy in one path while not substantially reflecting energy in another path.

9. The switched waveguide of claim 1, further comprising at least one additional reflector and an additional RF switch element per additional reflector configured to connect the additional reflector to the waveguide structure and to disconnect the additional reflector from the waveguide structure.

10. The switched waveguide of claim 1, further comprising a plurality of reflectors located within the waveguide structure, each reflector of the plurality of reflectors being connected to a corresponding RF switch element that is configured to connect and disconnect the corresponding reflector to the waveguide structure.

11. The switched waveguide of claim 1, wherein the waveguide structure has a two opposite sides and the monopole extends from one of the opposite sides to the other opposite side of the waveguide structure.

12. The switched waveguide of claim 1, wherein the waveguide structure is a substrate integrated dielectric waveguide structure.

13. A switched waveguide, comprising:

a waveguide structure having a feed port that enables excitation of the waveguide structure;

a first reflector located within the waveguide structure, the first reflector having a first end region and a second end region, wherein the first reflector is a monopole; and a first radio frequency, RF switch element configured to connect the first end region of the first reflector to the waveguide structure and to disconnect the first end region of the first reflector to the waveguide structure; and a second RF switch element configured to connect the second end region of the first reflector to the waveguide structure and to disconnect the second end region of the first reflector from the waveguide structure, wherein the first RF switch element is connected to the monopole at the first end region of the monopole and the second RF switch element is connected to the monopole at the second end region of the monopole, the first end region being opposite the second end region.

14. The switched waveguide of claim 13, further comprising at least one additional reflector located within the waveguide structure between the feed port and the first reflector; and at least a third RF switch configured to connect the at least one additional reflector to the waveguide structure and to disconnect the at least one additional reflector from the virtual ground.

15. The switched waveguide of claim 13, wherein the first reflector has a diameter less than λg/2, where λg is a waveguide wavelength.

16. The switched waveguide of claim 13, wherein the first reflector has a diameter greater than λg/8, where λg is a waveguide wavelength.

17. The switched waveguide of claim 13, wherein the first RF switch element is one of a PIN diode, a MEMS RF switch and a solid state switch.

18. The switched waveguide of claim 13, wherein the waveguide structure is one of an air and vacuum waveguide structure.

19. The switched waveguide of claim 13, wherein the waveguide structure includes a plurality of waveguide sections, each waveguide section having an output port, each output port coupled by the waveguide section to the feed port, each waveguide section providing a separate path for a flow of energy in the waveguide structure.

20. A switched waveguide, comprising:

a waveguide structure having a feed port configured to enable excitation of the waveguide structure;

a first reflector located within the waveguide structure, the first reflector having:

a first end region connected to the waveguide structure; and a second end region connected to a first radio frequency, RF switch element, wherein the first reflector is a monopole; and the first RF switch element configured to connect the first end region of the first reflector to the waveguide structure and to disconnect the first end region of the first reflector to the waveguide structure, wherein the first RF switch element is connected to the monopole at the first end region of the monopole and a second RF switch element is connected to the monopole at the second end region of the monopole, the first end region being opposite the second end region.

21. The switched waveguide of claim 20, wherein the waveguide structure includes a plurality of waveguide sections, each waveguide section having a corresponding output port, each output port coupled by the corresponding waveguide section to the feed port, each waveguide section providing a separate path for a flow of energy in the waveguide structure.

22. The switched waveguide of claim 21, wherein each of a plurality of the output ports are configured to connect to an antenna.

23. The switched waveguide of claim 20, wherein the waveguide structure has an output port configured to connect to a horn antenna.

24. A radio frequency, RF, device, comprising:

a waveguide structure having a feed port and an output;

an antenna electrically connected to the output;

a reflector located within the waveguide structure between the feed port and the output, wherein the reflector is a monopole having a first end region and a second end region, wherein the reflector has length between λg/3 and λg/8, where λg is a waveguide wavelength, defined as a function of a waveguide width 'a', speed of light 'c', relative permittivity "εr' of a material in the waveguide structure, and frequency of operation 'f' as follows:

$$\lambda_g = \frac{2\pi}{\sqrt{\frac{\epsilon_r(2\pi f)^2}{c^2} - \left(\frac{\pi}{a}\right)^2}}$$

a RF switch element configured to connect the reflector to the waveguide structure and to disconnect the reflector from the waveguide structure, wherein the RF switch element is connected to the monopole at the first end region of the monopole and a second RF switch element is connected to the monopole at the second end region of the monopole, the first end region being opposite the second end region.

25. The RF device of claim 24, wherein, when the RF switch element connects the reflector to the waveguide structure the reflector substantially reflects energy in the waveguide structure, and when the RF switch element disconnects the reflector from the waveguide structure the reflector does not substantially reflect energy in the waveguide structure.

26. A radio frequency, RF, device, comprising:

a waveguide structure, the waveguide structure including: a feed port; and a plurality of waveguide sections, each waveguide section having an output port, each output port coupled by the waveguide section to the feed port, each waveguide section providing a separate path for a flow of energy in the waveguide structure;

a reflector located within each waveguide section of the waveguide structure, wherein the reflector is a monopole having a first end region and a second end region, wherein the reflector has length between λg/3 and λg/8, where λg is a waveguide wavelength, defined as a function of a waveguide width 'a', speed of light 'c', relative permittivity "εr' of a material in the waveguide structure, and frequency of operation 'f' as follows:

$$\lambda_g = \frac{2\pi}{\sqrt{\frac{\epsilon_r(2\pi f)^2}{c^2} - \left(\frac{\pi}{a}\right)^2}}$$

a radio frequency, RF, switch element within each waveguide section, a RF switch element configured to connect a corresponding reflector in the waveguide section to the waveguide structure and to disconnect the reflector from the waveguide structure, wherein the RF switch element is connected to the monopole at the first end region of the monopole and a second RF switch element is connected to the monopole at the second end region of the monopole, the first end region being opposite the second end region; and a plurality of antennas, an antenna of the plurality of antennas being electrically connected to each output port.

27. The RF device of claim 26, wherein the switches in the waveguide sections are programmably controllable to substantially reflect energy in one path while not substantially reflecting energy in another path.

* * * * *